United States Patent [19]

Balasingam

[11] Patent Number: 4,841,759

[45] Date of Patent: Jun. 27, 1989

[54] AUTO GUIDING COMBINATION LOCK

[76] Inventor: Cathirgamathamby Balasingam, 102/2 Wolfendahl Street, Colombo 13,

[21] Appl. No.: 911,569

[22] Filed: Sep. 25, 1986

[51] Int. Cl.[4] ..... E05B 37/08

[52] U.S. Cl. ..... 70/302; 70/303 A; 70/305; 70/306; 70/312; 70/315; 70/321; 70/327; 70/330; 70/332

[58] Field of Search ..... 70/302–306, 70/308, 309, 310, 312, 313, 315, 319, 321, 323, 327–330, 332, 333 R

[56] References Cited

U.S. PATENT DOCUMENTS

| | | | |
|---|---|---|---|
| 2,601,774 | 7/1952 | Behrens et al. | 70/302 X |
| 2,611,259 | 9/1952 | Berry et al. | 70/302 X |
| 2,807,954 | 10/1957 | Miller | 70/303 R X |
| 2,836,049 | 5/1958 | Papini | 70/303 R X |
| 2,881,612 | 4/1959 | Smith et al. | 70/302 |
| 2,925,726 | 2/1960 | Miller | 70/302 X |
| 3,098,376 | 7/1963 | Miller | 70/302 X |
| 3,170,316 | 2/1965 | Miller et al. | 70/302 X |
| 3,391,556 | 7/1968 | Schull | 70/303 R X |
| 3,481,167 | 12/1969 | Barner | 70/303 R X |
| 4,048,823 | 9/1977 | Szova | 70/306 |
| 4,104,896 | 8/1978 | Hahn | 70/310 |
| 4,574,603 | 3/1986 | Parma | 70/303 A |

*Primary Examiner*—Gary L. Smith
*Assistant Examiner*—Suzanne L. Dino
*Attorney, Agent, or Firm*—D. Peter Hochberg; Mark M. Kusner; Louis J. Weisz

[57] ABSTRACT

A fast opening, high security combination lock includes a case, a dial connected to a rotatable spindle, and a plurality of rotatable tumblers mounted coaxially therewith. A movable impeller mounted on said spindle is carried by internal projections in the case to engage the tumblers in sequence as the dial is turned through a series of partial clockwise turns to combination characters and returns to a set mark. After setting the tumblers, the impeller engages a driver which, if all of the tumblers have been properly set, retracts a bolt. The impeller is reset to its initial position on the spindle and the tumblers are scattered to secure the lock, by rotating the dial one-half turn anti-clockwise.

11 Claims, 9 Drawing Sheets

FIG.1
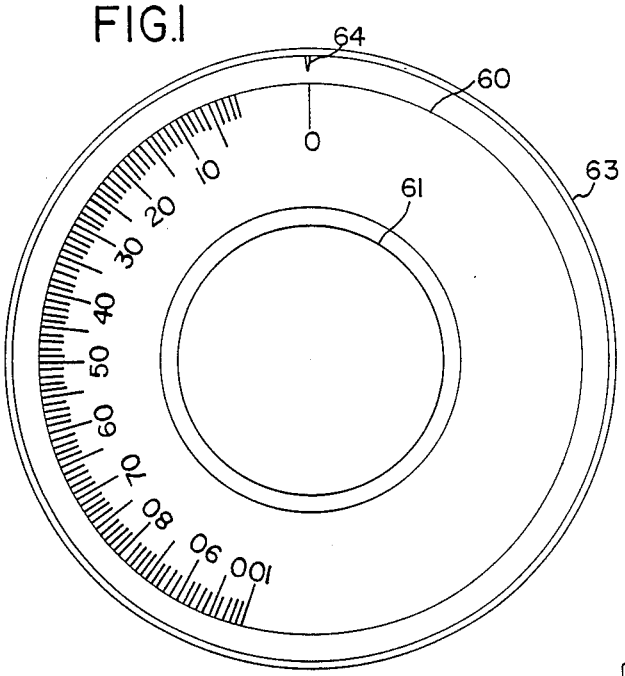
FIG.5
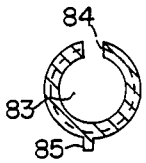
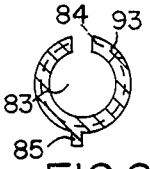
FIG.6
FIG.8
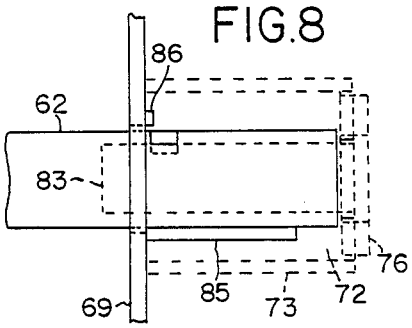
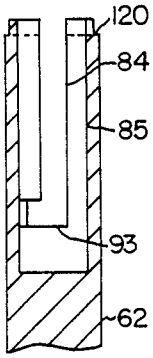
FIG.7
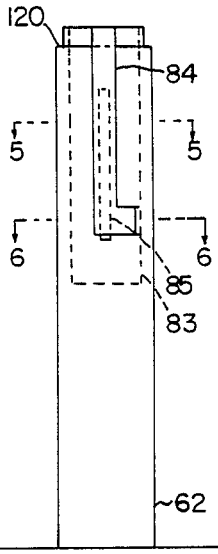
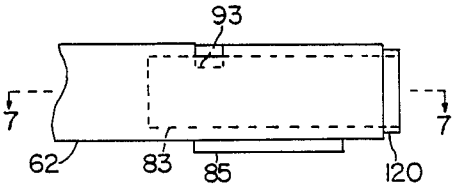
FIG.3
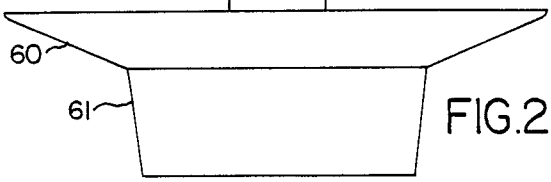
FIG.2

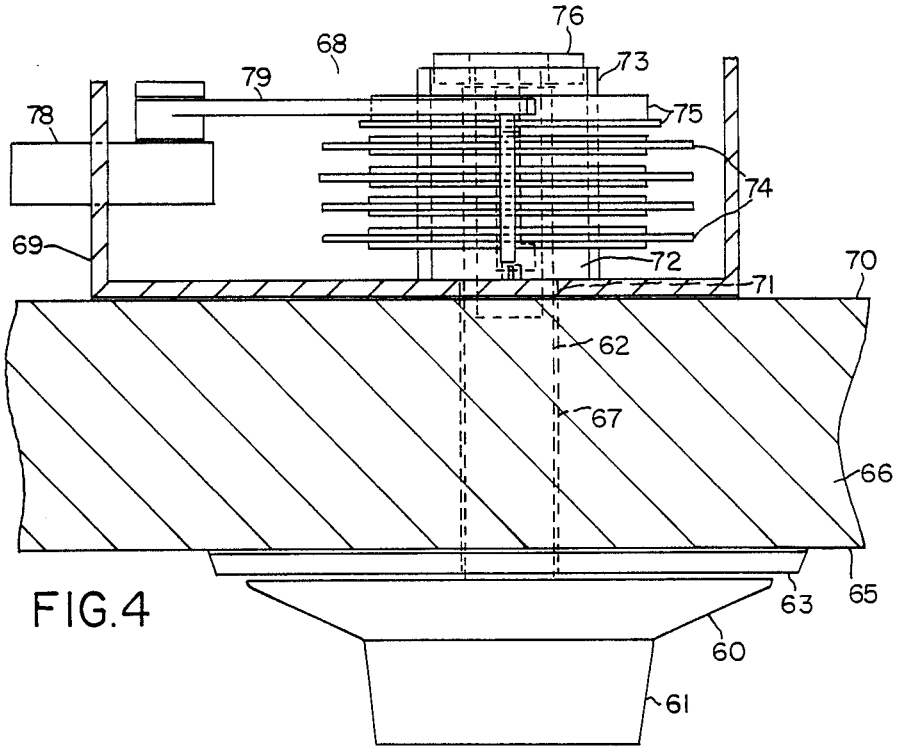
FIG.4
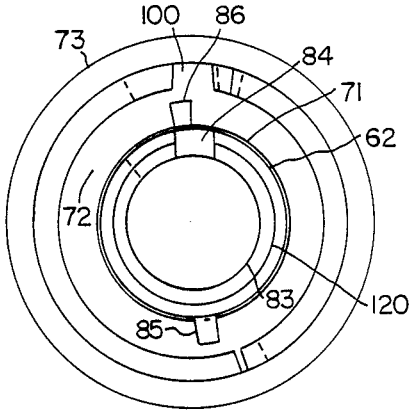
FIG.9
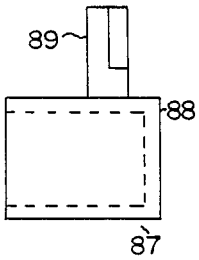
FIG.10
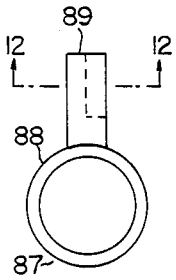
FIG.11
FIG.12
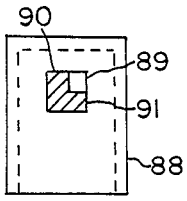

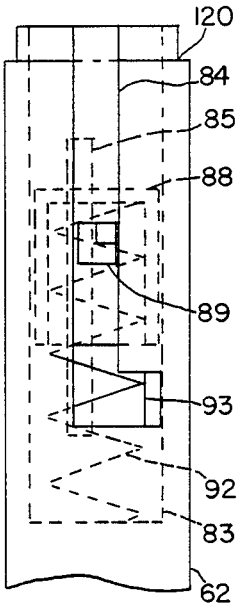
FIG.13
FIG.14
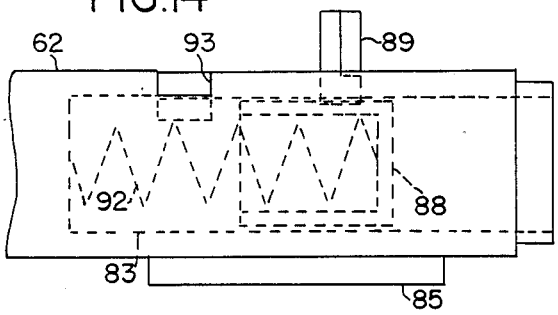
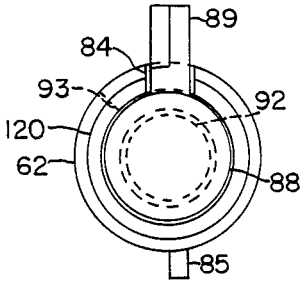
FIG.15
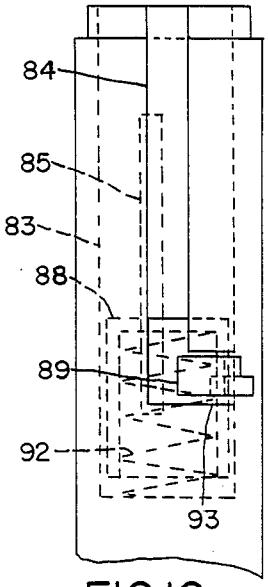
FIG.16
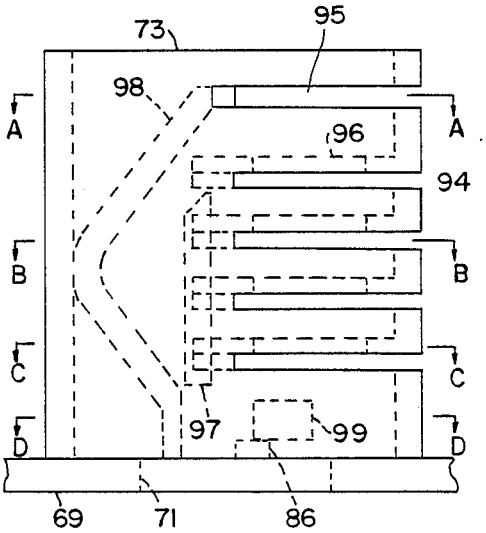
FIG.17
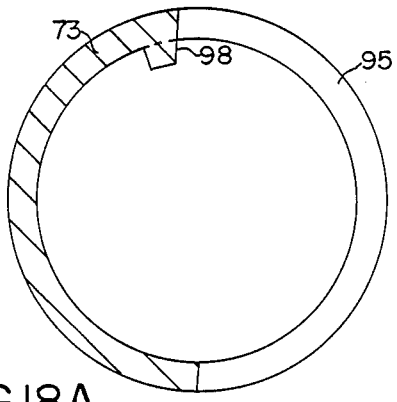
FIG.18A FIG.18B
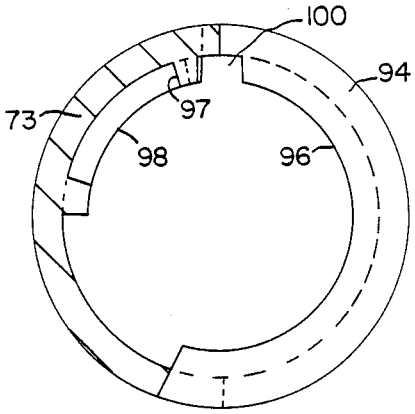
FIG.18C
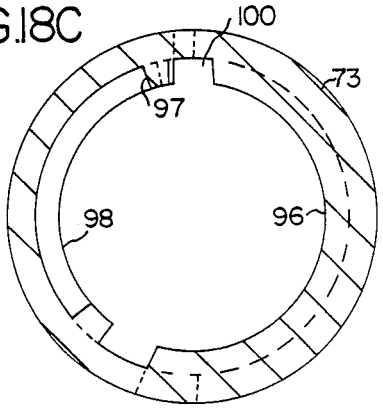
FIG.18D
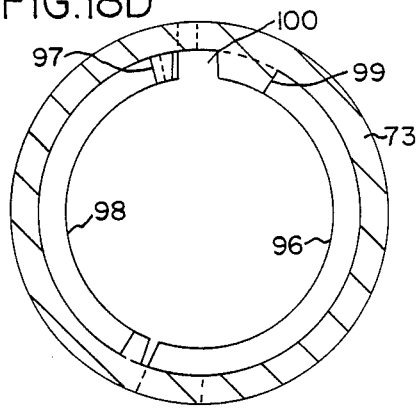
FIG.19
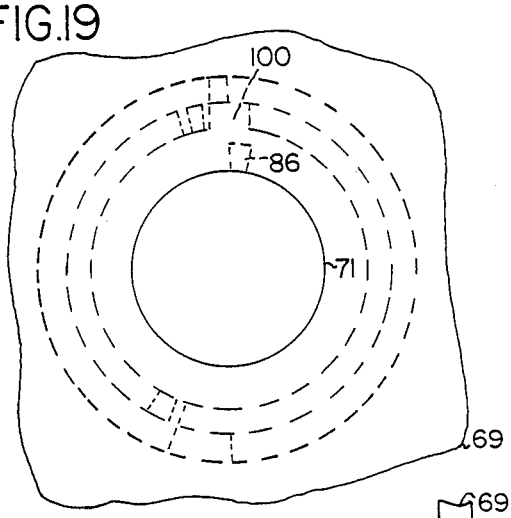
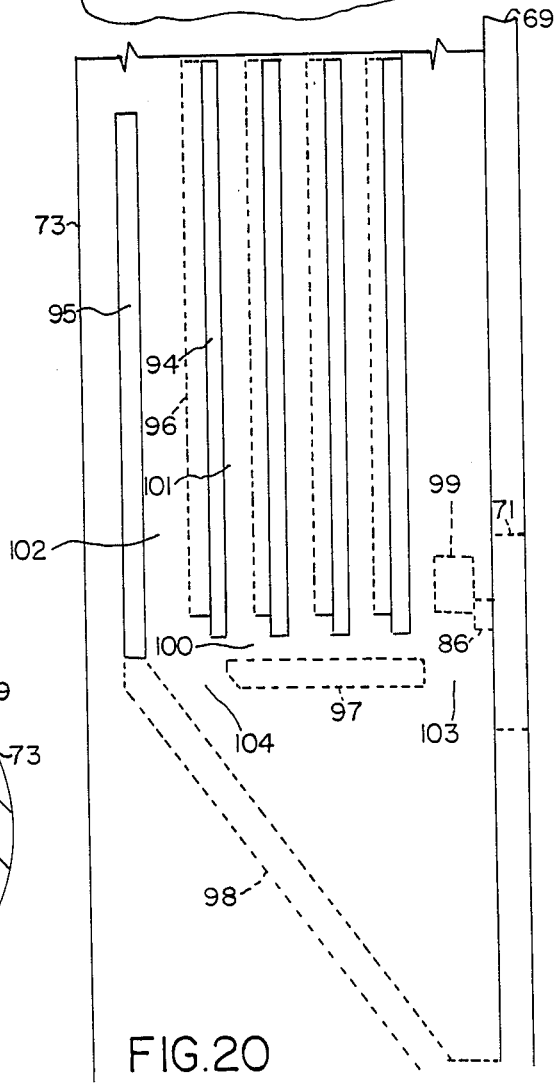
FIG.20

FIG.21
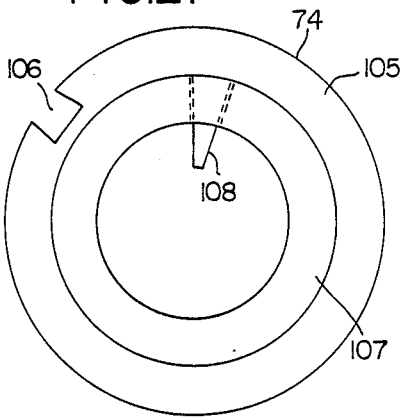
FIG.22
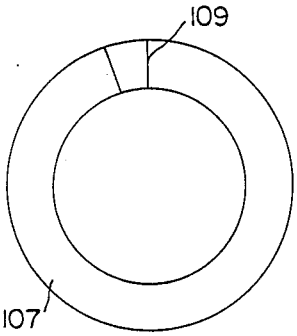
FIG.23
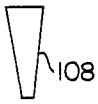
FIG.24
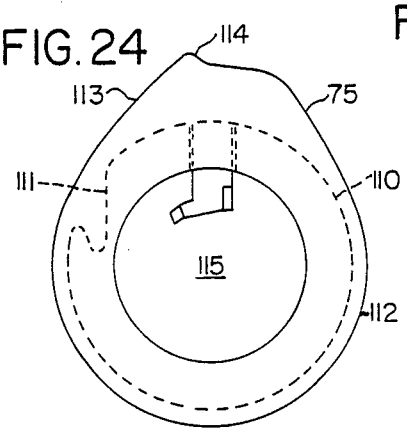
FIG.27
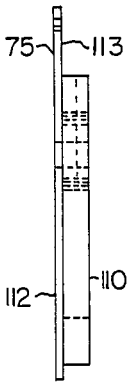
FIG.25
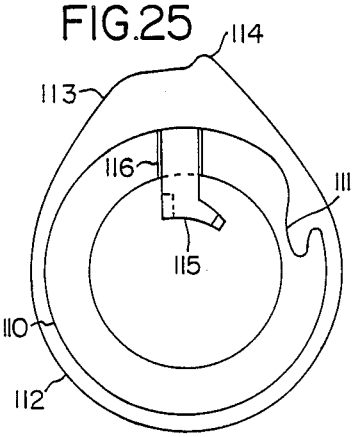
FIG.26
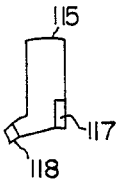
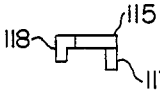
FIG.28
FIG.29
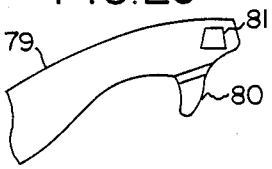
FIG.30
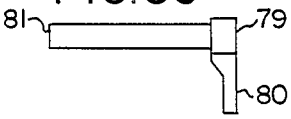

FIG.31
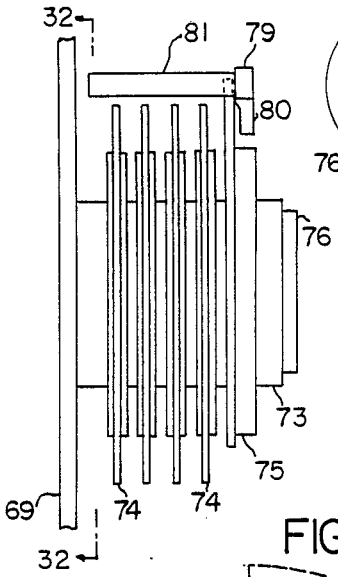
FIG.33
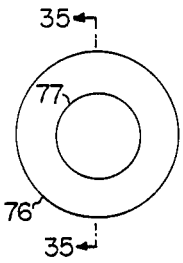
FIG.32
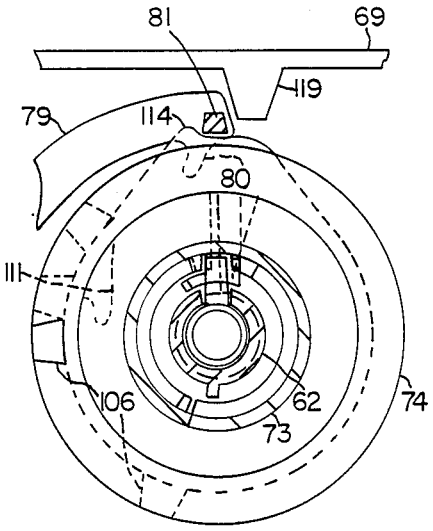
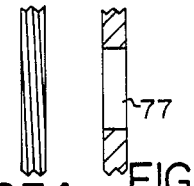
FIG.34
FIG.35
FIG.36
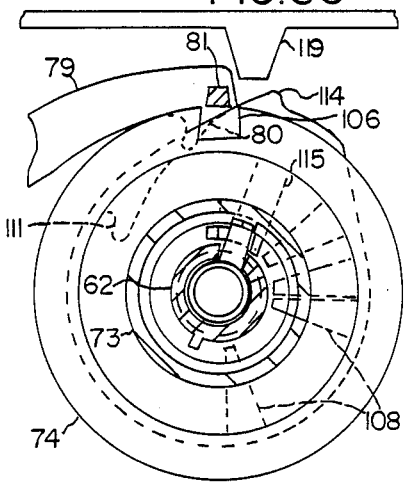
FIG.37
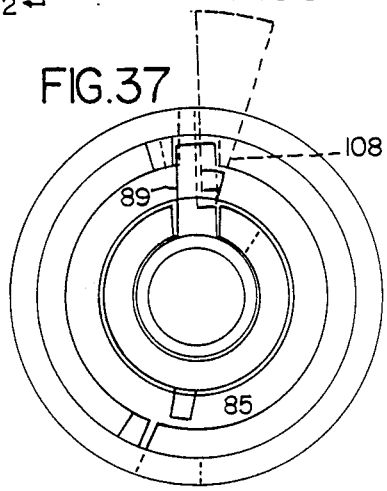
FIG.38
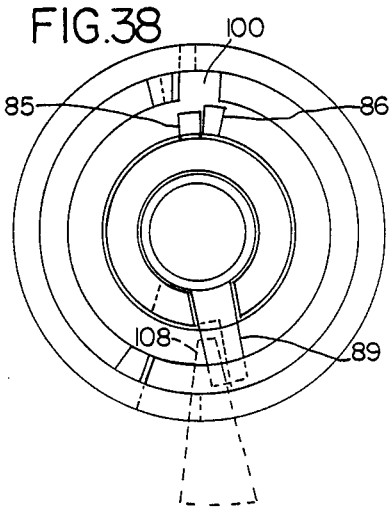
FIG.39
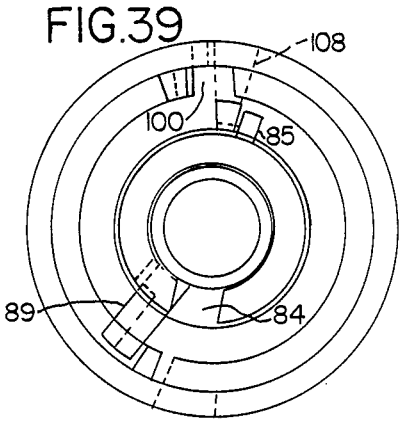

FIG. 40
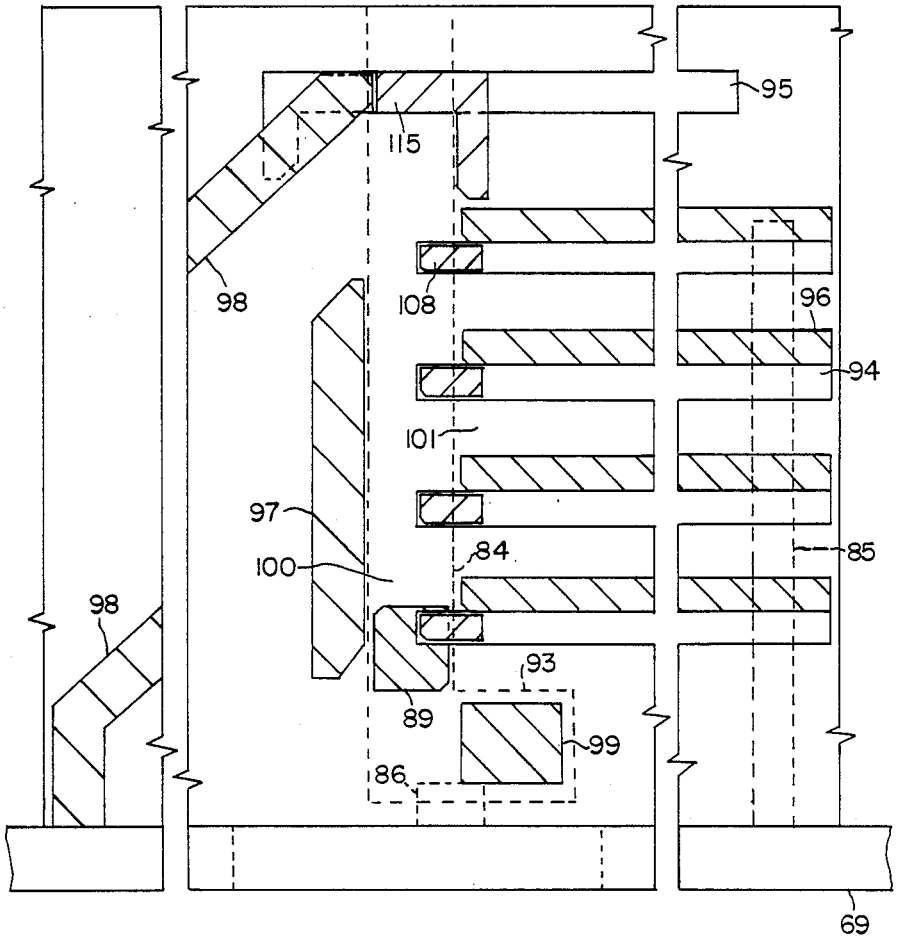
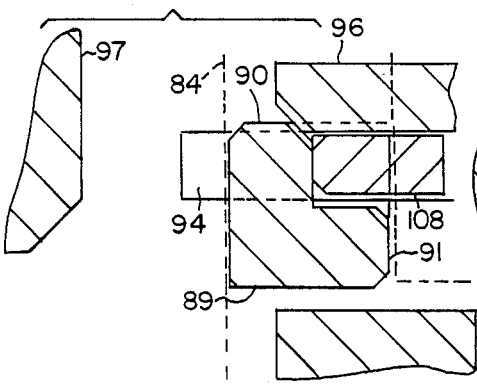
FIG. 41A
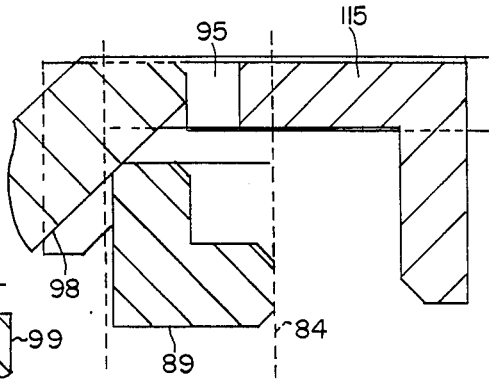
FIG. 41B

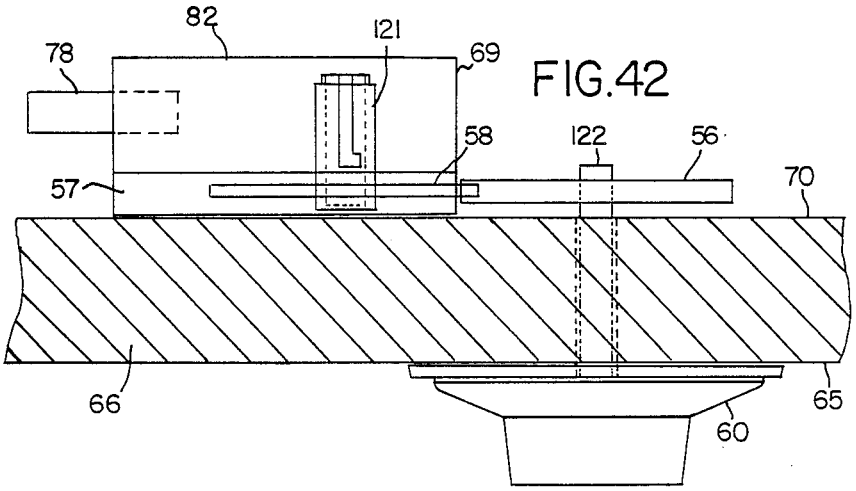
FIG.42
FIG.45
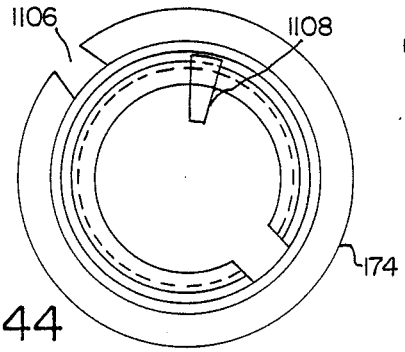
FIG.44
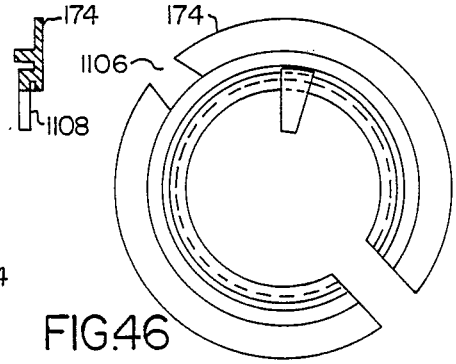
FIG.46
FIG.43
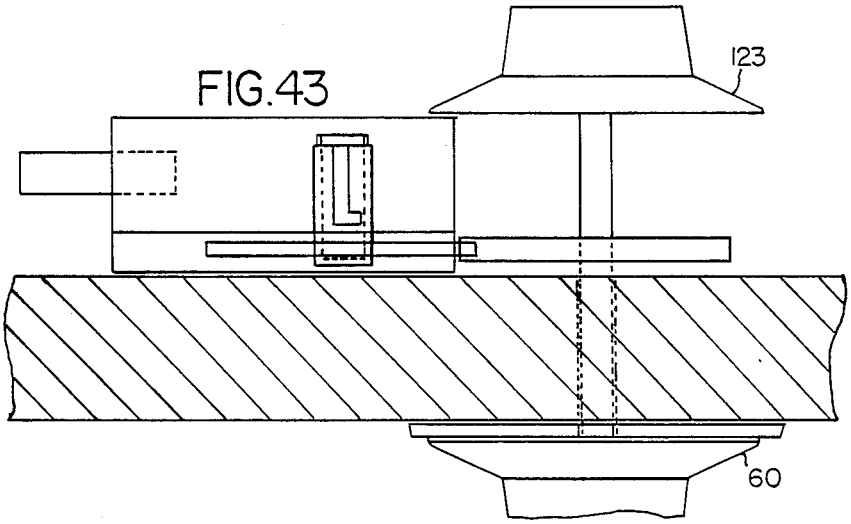

FIG.47
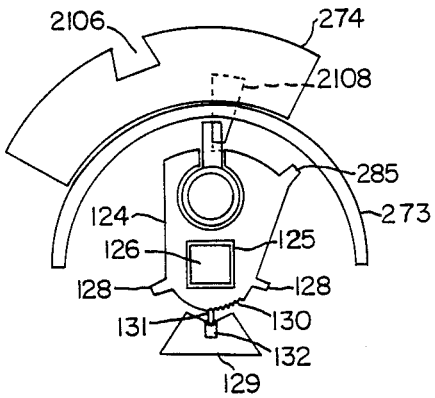
FIG.48
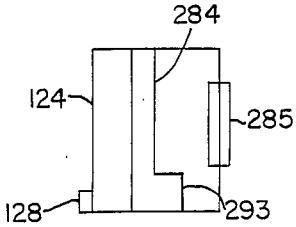
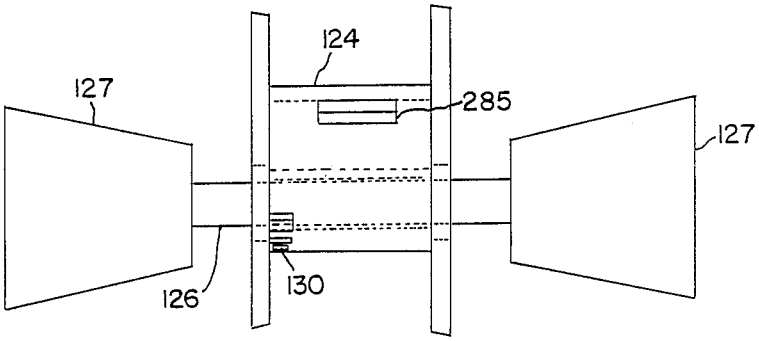
FIG.49

AUTO GUIDING COMBINATION LOCK

TECHNICAL FIELD

This invention relates to high security, keyless combination locks of the single dial, single spindle type used on safes and vault doors.

BACKGROUND ART

Combination locks are generally mounted on the inside of a door and include a long rotatable spindle running through the thickness of the door. A graduated dial is fastened to the front end of the spindle at the outside face of the door. A lock case, fitted on the inside face of the door and containing the lock mechanism, accepts the other end of the spindle. Inside the lock, the spindle generally runs through a hollow cylinder. A plurality of circular tumblers are coaxially mounted for rotation on the hollow cylinder. The spindle terminates at a driver which is a disc smaller than the tumblers but larger than the cylinder. The driver is keyed to the tip of the spindle just beyond the end of the cylinder. On the side facing the tumblers, the driver carries a small stub which engages similar stubs on the tumblers. This enables positioning of the tumblers by the driver by rotation of the dial the required number of turns in either direction. Each tumbler also incorporates a gating, the gatings being aligned for the unlocked condition. In general, drivers also incorporate a gap at their edge. The locks include a bolt to which is pivoted a spring-loaded drop arm. The drop arm usually includes a hook-like member to engage the gap in the driver and a projecting bar positioned outside the edges of the tumblers for engaging the gatings in the tumblers.

In some forms of locks the projecting bar rests on the edges of the tumblers with the hook-like member being suspended above the edge of the driver. As the tumblers are rotated by the driver, it is possible to analyze the changes in resistance when the gatings pass beneath the projecting bar. Such locks are pickable in this manner and can be compromised.

In other types of conventional locks, the projecting bar lies suspended outside the edges of the tumblers while the hook-like member rests on the edge of the driver. Picking by analyzing frictional changes is not generally possible in these locks. However, as the tumblers are rotated by the driver, at one time during each rotation the gap in the driver passes underneath the hook-like member. In this position the hook-like member stays in a suspended position because the projecting bar rests on the edges of the tumblers. The gap in the driver is generally a substantial portion of the driver's overall circumference. Hence, the combination numbers coinciding with the gap in the driver are still pickable. On average, the gap covers about ten percent (10%) of the circumference of the driver. Thus in a four (4) tumbler lock, only about sixty-five percent (65%) of the total four (4) number combinations are truly unpickable; the remaining thirty-five percent (35%) of the combinations are still fully or partly pickable.

A further disadvantage of existing combination locks is that a person using the locks will neither be able to identify the two (2) categories nor differentiate between the pickable and unpickable ranges in locks of the second type. Hence, a user is always uncertain about the degree of security for all combinations in all locks.

Apart from pickability by analyzing frictional changes, all forms of the above-mentioned combination locks fail to offer adequate resistance to force attacks due to their use of a single direct drive spindle. A common method employed by criminals to compromise such locks is to shear, break or disjoin the dial on the outside and drive the spindle inwards. The spindle and the driver fastened thereto generally dislodge the cap of the lock case. In some situations, the entire lock or the part of the lock containing the bolt is dislodged from position; thus rendering the lock ineffective and facilitating opening of the safe. In other cases because the spindle hole passes through the central part of the lock, the lock can be easily dislodged through the cleared hole using suitable tools. Thus the direct drive spindle arrangement is a very serious weakness in the combination locks known in prior art.

Conventional combination locks of the type previously referred to have certain other inherent weaknesses which are equally serious. When a conventional combination lock is locked, it does not provide the user with any direct or distinct indication that all tumblers are effectively scattered and that it is at full security. Throughout the world the accepted method for locking is to rotate the dial at random. According to "An Encyclopedia of Locks and Builder's Hardware" published by Josiah Parkes and Sons, Ltd., a "few random turns" are required to "effectively scatter the combination" and bring the lock to "full security". There is however, no clear-cut instruction from lock manufacturers and dealers on the actual or minimum extent of what is "a few random turns".

In the absence of specific instructions, a user generally rotates the dial one (1) or two (2) turns both ways a few times and believing that he has effectively executed locking, leaves the dial in position. He is unaware of the real end result of the rotating movements, which based on various factors, particularly the combination numbers and direction and extent of rotation, can vary considerably in the same lock or from lock to lock.

In a four (4) tumbler combination lock as an example, in some cases a one (1) turn rotation can effectively scatter (or move from original unlocking positions) all four (4) tumblers; but in the same lock in some other cases, even two (2) rotations beginning from the unlocked, bolt withdrawn condition, may only scatter one (1) or a maximum of two (2) tumblers from the distal or driver end. This would leave the other three (3) or two (2) proximal end tumblers that are furthest from the driver in their originally set, unlocked position. In such cases, pick locks can easily find out the combination numbers for the unscattered proximal end tumblers even if such tumblers are not pickable by analyzing frictional changes. This is done by what is known as the continuous one-way rotation method. Using this method the pick-lock rotates the dial in a direction, either clockwise or anti-clockwise, from the position in which the lock has been left by the user. The rotation is continued over a required number of turns. By studying the intermittent and distinct increases in load, the pick-lock may discover the numbers at which the tumblers get connected one after the other for rotation. Even though the first one (1) or two (2) numbers related to the one (1) or two (2) scattered tumblers are of no use, the last two (2) or three (3) numbers related to the two (2) or three (3) unscattered tumblers would be the precise combination numbers for unlocking the lock, but in the reverse order.

The dial-spindle-driver assembly of conventional locks by itself offers hardly any resistance to rotation. The tumblers are usually lightly spring-loaded on purpose to provide some stability in resistance to rotation. For such arrangement the increases in rotational load as the stubs on the tumblers engage can be clearly felt and identified by a pick-lock.

In the event a lock is not precision made or properly assembled, every other number may vary by a unit or so from the originally set number due to the change in direction of rotation required thereat. However, the expert pick-lock can easily ascertain the correct direction, the quantum of variations, if any, and the numbers requiring adjustments to make the necessary correction. In addition, if the pick-lock gets one (1) or more opportunities to study the numbers prior to his final attack, he can compare and confirm the combination numbers. In cases of "inside jobs" or attacks with inside support, such opportunities are adequately available.

Armed with the combination numbers for the proximal end tumblers, it will not take much time for a pick-lock to unlock the lock even if the combination numbers for the scattered distal end tumblers are not pickable by analyzing frictional changes. By taking advantage of the weakness of conventional combination locks, a pick-lock can actually try every combination for the remaining tumbler or tumblers in a short time by selective manipulation. In this method the pick-lock can overcome the need for repeating complete cycles of operations when attempting various combinations. He simply keeps the proximal end tumblers furthest from the driver positioned according to the numbers he has previously determined using the continuous one-way rotation method. Thus, he can confine his work to the remaining tumbler or tumblers for which the combination numbers remain unknown. By selectively engaging only the remaining tumblers and by operating in the required sequence and direction, the pick-lock can complete the task within manageable time limits. Being an expert he would probably require a maximum of about five (5) minutes if only the last number is unknown and a maximum of about nine (9) hours if the last two (2) numbers are unknown. Because the pick-lock would not have to try all combinations for the unknown numbers before discovering the correct combination numbers, on average it would only take about one-half ($\frac{1}{2}$) the maximum times quoted.

Discontinuing the process of unlocking a conventional combination lock halfway through the process, presents another risk. A number of users thinking that no scattering is needed as they have not opened the lock, may leave their locks in such conditions. Others may leave the process of dialing the combination partially completed to minimize the time required to gain access to the safe or vault. Such persons generally seldom appreciate the risks involved.

A conventional combination lock left in the fully unlocked condition can similarly reveal all of its combination numbers to pick-locks. A dishonest assistant entrusted with the task of locking a combination lock can easily find out all the numbers for the combination in the process of his locking by applying the continuous one-way rotation method. Such situations occur often in dual control arrangements where a superior officer controlling one lock instructs his assistant to lock it at the end of the day.

Thus, there exists a need in the prior art for a lock with a simple, speedy and standard system for instant locking and for providing at all times and for all combinations the maximum security which can be achieved by fully scattering the tumblers. There further exists a need for a lock which overcomes the insufficiency of existing locks that lack any facility to indicate the degree of scattering of the tumblers when the lock is attempted to be secured. The fact that the tumblers may reveal their individual positions by load increases when the tumblers are left fully unscattered is a further disadvantage of prior art locks. Combination locks of conventional design further suffer from the deficiency that a pick-lock having learned the first several combination numbers may through repeated positioning of the tumblers closer to the driver, discover the remaining numbers without having to disturb the previously positioned tumblers further from the driver. The fact that combination data can be extracted by the continuous one-way rotation of tumblers in a lock which has been left in the open position is also a very serious weakness endangering the security of locks known in the prior art. All of these deficiencies establish the need for a lock having enhanced security features.

In addition to pickability by analyzing frictional changes and susceptibility to forced attacks and the other weaknesses and disadvantages mentioned above, conventional combination locks also cause some serious operating discomfort to their users. When a lock of conventional design must be unlocked, the tumbler positioning process of even a four (4) tumbler lock involves fourteen (14) closely observed rotations beginning in a prescribed direction and changing directions after five (5), four (4), and three (3) rotations. This apart from being time-consuming and irritating causes real confusion and chaos to many. In addition, if a conventional combination lock is to be reset to a new combination, the process is extremely laborious, involving three (3) extra cycles of tumbler positioning operations and requiring a total of forty-four (44) extra rotations.

DISCLOSURE OF INVENTION

It is an object of the present invention to provide a keyless combination lock of the single dial, single spindle type that is theoretically unpickable and that is capable of concealing its combination digits, thus offering absolute safety in respect to all combinations and under all circumstances.

It is a further object of the present invention to provide a combination lock having a simple, speedy and standard system of operation.

It is a further object of the present invention to provide a combination lock that is constructed so as to eliminate any possibility of dislodging the lock or its vital parts by applying force to the spindle or through the spindle hole.

It is a further object of the present invention to provide all of the foregoing characteristics in a lock of simpler construction than locks previously known.

Further objects of the present invention will be made apparent in the attached description of the Best Modes for Carrying Out the Invention and the appended claims.

The foregoing objects are accomplished by a combination lock having a dial mounted on the outside of a safe or other secure door. The dial is connected to a spindle which extends through the door into a case of the lock. The spindle is journaled in the front or proximal plate and rear or distal plates of the lock case. The spindle is held in relative position by a raised ridge tumbler retractor which extends radially outward from the spindle inside the lock case and thus prevents the spindle from being pulled therefrom.

A radial hole in the spindle extends from the rear of the spindle and through the lock to form a spindle tube. A slit is cut longitudinally through the spindle tube opposite the tumbler retractor. The slit includes a small circumferential retention recess at its front end just inside the front wall of the lock case. A cylindrical impeller is mounted in the spindle tube. The impeller includes an "L-shaped" impeller bit which extends radially outward through the slit. The impeller is spring-biased toward the rear of the spindle.

The lock case incorporates a cylinder which is concentric with the spindle. Cut through the cylinder are a plurality of circumferential tumbler slits which begin near top center and extend approximately half way around the cylinder. A driver slit is also cut in the cylinder near the rear of the lock. The driver slit begins slightly before top center and extends the same angular distance as the tumbler slits.

Circular ring tumblers are mounted on the cylinder over the tumbler slits. Each tumbler incorporates an ear which extends from its inner surface through the slit and which is of sufficient length to contact the impeller bit and tumbler retractor of the spindle. Each tumbler incorporates a square-cut gating in its outer circumference. The tumblers are held in properly spaced position over the slits by washers.

A circling driver is mounted on the cylinder adjacent to the driver slit. The driver incorporates a driver ear which extends through the driver slit. The driver ear includes a pair of wings which form a channel portion sized for accepting the impeller bit. The driver is held in properly spaced relation to the tumblers with washers. The stack consisting of the driver and the tumblers is prevented from lateral movement with respect to the cylinder by locking means and is constructed to enable the driver and the tumblers to rotate freely to the extent that the ear of each can travel in its associated slit.

The driver also incorporates a disk. The driver disk includes a hooked gap. The driver also includes an extended flange which extends radially outward beyond the outer surfaces of the tumblers.

The lock includes a sliding bolt which extends from the lock case in the locked position in the conventional manner. A drop arm is pivotally mounted to the bolt for imparting movement thereto. The drop arm includes a hook-like member for acceptance into the hooked gap in the driver disk when the bolt is retracted. A projecting arm extends from the drop arm over the tumblers and the driver, along a line parallel to the center line of the spindle. The drop arm is sized to be accepted into the gatings of the tumblers and to fall therein when all the tumbler gatings are aligned. In the locked condition the drop arm rides on the extended flange of the driver and is beyond the outer surfaces of the tumblers. In this position the hook-like member of the drop arm is above and out of contact with the driver disk.

Projecting inward inside the cylinder of the lock are a number of projections which serve to guide the impeller bit along a course from the front to the back of the lock. During the course of unlocking, the impeller bit serves to sequentially and independently rotate each tumbler so the gatings are aligned if the proper combination has been dialed. After the last tumbler has been positioned, the impeller bit contacts and can rotate the driver to unlock the lock. The projections include impeller releases associated with each tumbler slit and which extend around the full arc thereof. The impeller releases serve as a support surface for the impeller bit as it positions each tumbler ear. The impeller release projections carry the spring force of the bit to insure that the bit only pushes the tumbler ear to the desired rotational position and does not carry the ear back with the bit once the tumbler has been set.

An impeller guide projection extends longitudinally inside the cylinder and is mounted slightly before top center. The guide prevents the bit and spindle from being rotated anti-clockwise of top center except when the bit is at the very front or rear of its travel in the spindle tube. The space between the releases and the guide at the inside top center of the cylinder forms a corridor which enables the bit to move longitudinally from front to back in the lock when the bit is at top center.

An impeller retractor projection extends in a half-circular spiral inside the cylinder on the side opposite the slits. The retractor projection begins at the driver slit and ends near the front of the lock case. There is sufficient space between the front and rear edges of the impeller guide and the front and rear edges of the impeller retractor to allow the impeller bit to pass through at those locations.

The last projection inside the cylinder is the impeller ejector. It extends radially inward at the front of the cylinder. The impeller ejector is positioned so that the impeller bit cannot be positioned in the retention recess of the slit in the spindle tube when the lock dial is at a "zero" set mark.

The unlocking sequence for the lock of the preferred embodiment of the present invention begin with the dial at the set mark which causes the impeller bit to be placed at top center in the cylinder. Prior to unlocking, the tumblers are arranged with their gatings scattered but with their ears are all aligned near the top of the tumbler slots. The driver ear is at the beginning of the driver slot in line with the tumbler ears. The projecting bar of the drop arm is positioned on the extended flange of the driver away from the tumblers. The impeller bit begins in contact with the ear of the first tumbler which serves as first engagement means. A person opening the lock moves the lock dial clockwise to the first character of the combination. This causes the ear of the first tumbler to move to a position which puts the gating of the tumbler in alignment with the projecting bar. The dial is then moved anti-clockwise to the set mark while the first tumbler remains in the set position. As the bit reaches the end of the impeller release associated with the first tumbler, it is freed and plunges due to spring pressure rearward until contacting the ear of the second tumbler. The dial cannot be moved anti-clockwise of the set mark because such movement is prevented by the impeller guide projection inside the cylinder.

The second tumbler is positioned so that its gating is in line with the first as the dial is moved clockwise to the second character of the combination. As the dial is returned to the set mark, the impeller bit plunges to the third tumbler which then can be set. Thus, the impeller release projections in combination with the impeller spring serve as first movement means for moving the impeller sequentially from tumbler to tumbler. This process continues until all the tumblers are set and their gatings are aligned.

Once the last tumbler has been set, the impeller bit plunges rearward for a final time into the channel portion between the wings of the driver ear, which serves as second engagement means. From this position, rotation of the dial in the clockwise direction moves the projecting bar of the drop arm off the extended flange of the driver and causes it to fall downward to the level of the outer surface of the tumblers. Because the gatings of the tumblers are all aligned as the result of the correct combination being dialed, the projecting bar falls into the gatings. Once the projecting bar has fallen into the gatings the hook-like member of the drop arm falls sufficiently so that it is in contact with the disk of the driver, which serves as third engagement means. The hook will then catch in the gap of the driver disk as the driver rotates and further rotation of the dial will in turn, move the drop arm and the bolt.

To relock the lock, the dial is first moved anti-clockwise back to the set mark which extends the bolt. The dial is then turned further anti-clockwise, which causes the impeller bit to contact with the impeller retractor projection. As the dial is further rotated anti-clockwise, the forward spiral of the impeller retractor moves the bit off the driver ear and pushes the bit forward in the spindle to the very front where it is then pushed sideways and comes to rest in the recess at the front of the slit, which serves as holding means. At one-half ($\frac{1}{2}$) turn of anti-clockwise rotation from the set mark, further rotation of the dial is prevented by a stop. When the dial has reached its full travel in the anti-clockwise direction, the tumbler retractor on the bottom side of the spindle which serves as second movement means and has pushed all the tumbler ears back to their original positions, which also results in the gatings of the tumblers being scattered. From the full anti-clockwise position, the dial is then moved clockwise again to the set mark. As the dial approaches the set mark, the ejector projection inside the cylinder acts as releasing means and pushes the impeller bit out of the recess, which causes it to plunge rearward and engage the ear of the first tumbler. The impeller retractor, holding means and releasing means thus serve as third movement means for moving the impeller from engagement with the driver to engagement with the first tumbler. The lock is now fully secured and is in position to begin the unlocking process again.

BRIEF DESCRIPTION OF DRAWINGS

FIG. 1 is a front elevational view of a dial of the combination lock of the preferred embodiment of the present invention. The dial is shown with the knob and indicator disk all fitted on the front face of a door.

FIG. 2 is an elevational view of the dial and knob of FIG. 1 with a spindle attached thereto.

FIG. 3 is a fragmentary side elevational view of the spindle.

FIG. 4 is an elevational view similar to FIG. 2 showing the arrangement of the dial, the spindle extending through the door, and the lock with its major internal components.

FIGS. 5 and 6 are cross-sectional views of the spindle taken on lines 5—5 and 6—6 of FIG. 2, respectively.

FIG. 7 is a longitudinal sectional view of the spindle taken on line 7—7 of FIG. 3.

FIG. 8 is a side elevational view of the spindle showing its position in relation to the lock case as well as the relative positioning of the cylinder and closer.

FIG. 9 is an end elevational view of the spindle showing the positioning of the impeller retractor in relation to the stop stump at the spindle hole in the lock case. Also shown in dotted lines are the relative positions of the cylinder and cylinder projections.

FIG. 10 is a side elevational view of the impeller.

FIG. 11 is a front elevational view of the impeller.

FIG. 12 is a cross-sectional view of the impeller taken on line 12—12 of FIG. 11.

FIG. 13 is a fragmentary view of the spindle with the impeller and spring located in the spindle tube.

FIG. 14 is a side elevational view of the spindle and impeller.

FIG. 15 is an end elevational view of the spindle and the impeller.

FIG. 16 is a view similar to FIG. 13 but with the impeller bit retained in the impeller retention recess.

FIG. 17 is a top elevational view of the cylinder with hidden portions of the slits and inside projections shown in dotted lines.

FIGS. 18*a*, 18*b*, 18*c* and 18*d* are cross-sectional views of the cylinder taken along lines a—a, b—b, c—c, and d—d respectively in FIG. 17.

FIGS. 19 and 20 are longitudinal sectional views of the cylinder.

FIG. 21 is a front elevational view of a tumbler showing the inner ring, outer ring and ear.

FIG. 22 is a rear elevational view of the inner ring showing the tumbler ear recess therein.

FIG. 23 is an elevational view of the ear shown in FIG. 21.

FIG. 24 is a front elevational view of a driver with driver ear.

FIG. 25 is a rear elevational view of the driver with driver ear.

FIG. 26 is a front elevational view of the driver ear.

FIG. 27 is a side elevational view of the driver and driver ear.

FIG. 28 is an end view of the driver ear.

FIG. 29 is a fragmentary front elevational view of the drop arm showing the hook-like member and projecting bar.

FIG. 30 is a side elevational view of the drop arm.

FIG. 31 is a diagrammatic sketch showing four (4) tumblers and the driver arranged around the cylinder along with the drop arm and projecting bar.

FIG. 32 is a cross-sectional view taken along line 32—32 of FIG. 31 and showing the lock in the locked condition.

FIGS. 33 and 34 are front and side elevational views of the closer.

FIG. 35 is a longitudinal sectional view of the closer taken on line 35—35 of FIG. 33.

FIG. 36 is a view similar to FIG. 32 but with all tumblers correctly positioned and with the driver in the process of rotation for withdrawing the bolt.

FIGS. 37, 38 and 39 are diagrammatic sketches showing the spindle with the impeller in its standard position along the corridor of the cylinder, as well as the maximum rotation of the impeller in either direction for tumbler positioning and tumbler retracting.

FIG. 40 is a stretch-out view of the cylinder and spindle showing the path taken by the impeller bit and other moving parts within the cylinder during a cyclic unlocking and locking operation.

FIG. 41*a* shows the impeller bit engaging a tumbler ear.

FIG. 41*b* shows the impeller bit engaging the driver ear.

FIG. 42 is an alternative arrangement for a driving spindle of the lock of the present invention.

FIG. 43 is a sketch similar to FIG. 42 showing a further embodiment of the lock with indirect drive arrangement, which includes an additional dial on the inside of the door.

FIG. 44 shows an alternative tumbler for use in the present invention.

FIG. 45 is a cross-sectional view of the ear and tumbler shown in FIG. 44.

FIG. 46 is an elevational view of a second alternative tumbler.

FIG. 47 is an alternative embodiment of the lock of the present invention.

FIG. 48 is a top elevational view of the alternative embodiment shown in FIG. 47.

FIG. 49 is a side elevational view of the alternative embodiment shown in FIG. 47.

BEST MODES FOR CARRYING OUT INVENTION

Referring now to the drawings, FIGS. 1–41 illustrate the preferred embodiment of a combination lock of the single dial/single spindle type of the present invention. In this embodiment a dial 60 having a knob 61 on its front face is mounted on a spindle 62.

In this preferred embodiment, the dial is not rotatable in full circles, either clockwise or anti-clockwise. It is rather graduated for clockwise rotation from 0 to 100 over an arc of a little less than a half-circle. All divisions from 1–100 are uniform but the first division from 0 to 1 is comparatively much wider. The dial is rotatable in the clockwise direction from the 0 mark to any point up to the 100 mark and reversible therefrom. In a particular instance only, as will be later explained, the dial is also rotatable from the 0 mark in the anti-clockwise direction to a reset position and reversible back to 0. The arc for anti-clockwise rotation is not graduated.

The spindle runs rearwardly through the center of an indicator disk 63 carrying a setting mark 64. The indicator disk is fastened to a front face 65 of a door 66 behind the dial. Beyond the indicator disk the spindle runs through a spindle hole 67 in the door and into the lock 68 containing the mechanism (see FIG. 2).

The lock is fastened by fastening means (not shown) through its lock case 69 to the inside face 70 of the door. The spindle enters the lock through a spindle hole 71 in the lock case and runs through an axial hole 72 formed inside a hollow cylinder 73 which is an integral part of the lock case.

Unlike conventional locks, axial hole 72 is much wider than the spindle providing a void between the spindle and the cylinder wall for the movement of the necessary parts of the lock.

On the cylinder 73 beginning from the proximal end near the lock case, are mounted for rotation a plurality of tumblers 74. A driver 75 near the distal end is similarly mounted on the cylinder. The tumblers and the driver are spaced and positioned with suitable washers (not separately shown) to form a stack. The tumblers and driver are very lightly spring-loaded and are held in place on the cylinder at the end by locking means (not shown).

The cylinder hold is closed at the distal end with a closer 76 having an axial hole 77 for the tip of the spindle to pass through to provide proper centering (see FIGS. 33–35).

The lock contains the usual bolting arrangement with a slideable bolt 78 extending to the outside through a side hole in the lock case. Pivoted to the bolt is a drop arm 79 which includes a hook-like member 80 (see FIG. 29) which is in line with a substantial portion of the driver 75 for engagement (see FIG. 31). A projecting bar 81 on drop arm 79 extends forwardly over the remaining portion of the driver and all the tumblers (see FIG. 30).

The lock case is fitted with a cap 82 for covering the lock mechanism in a conventional manner.

The rear portion of the spindle is bored from the distal end to form a tube 83 (see FIGS. 2 and 7). The wall of the spindle tube over a major portion of the distal end includes an opening or slit 84 in one side. On the side of the spindle diametrically opposite slit 84, the spindle tube carries a tumbler retractor 85. The tumbler retractor is an outwardly directed ridge-like radial projection extending a little less than halfway into the void between the spindle and the inside wall of the cylinder (see FIGS. 8 and 9). In relation to the lock case and mechanism, the bored spindle tube 83 begins from a joint slightly before the lock case and extends up to the distal end (see FIG. 8). The slit 84 in the tube begins at the inside front face of the lock case and extends to the distal end. The tumbler retractor 85 also begins from the line of the inside front face of the lock case but extends only over the area of the cylinder where the tumblers are mounted.

The tumbler retractor 85, in addition to its main function of retracting tumblers when required as later explained, also serves two (2) other functions. The first of these functions is to keep the spindle in its correct longitudinal position so it cannot be pulled out by the dial end through the spindle hole 71 in the lock case. This is prevented by the interference action of the retractor with the front lock case wall. The second function of the tumbler retractor is to limit rotation of the spindle in either direction to the required extent by acting against a small stop stump 86 projecting rearwardly into the lock from the inside face of the lock case wall 69 near the mouth of the spindle hole (see FIG. 8).

Inside the spindle tube is a movable impeller 87 (see FIGS. 10 and 12). The impeller consists of a cylindrical body 88 which is hollow over a substantial portion from the front end. Integral with body 88 is an impeller bit 89. Impeller bit 89 projects radially from the body and extends through slit 84 and into the void between spindle 62 and cylinder 73 more than three-fourths ($\frac{3}{4}$) way to the inside cylinder wall (see FIGS. 13 and 14). In cross section, the portion of the impeller bit within the spindle tube slit is rectangular and of suitable width to slide through, but the portion extending into the void is essentially "L-shaped" with one corner portion removed (see FIGS. 12 and 15). The L-shaped portion includes a longitudinal arm 90 directed backwards and a lateral arm 91 directed in the clockwise direction. The impeller bit must be of sufficient strength to operate the tumblers, the driver, the drop arm and the bolt.

The impeller 87 is spring-loaded by a coil compression spring 92 as shown in FIG. 13. The spring occupies the forward section of the spindle tube and is accepted into the hollow section of the impeller body. Spring 92 constantly biases the impeller rearwardly. The force of spring 92 enables the impeller to slide up to the very end of the spindle tube 83 and slit 84.

Slit 84, at the front end of the spindle tube is widened laterally by a square cut in the clockwise direction to create a retention recess 93 for accepting the impeller bit (see FIG. 7). The impeller 87 when drawn to the forward end against spring pressure, can be retained in that position as the impeller bit is held in the impeller retention recess 93. The cylindrical body 88 of the impeller enables the impeller to rotate for this purpose.

Cylinder 73 contains a plurality of narrow open slits through its wall. These slits include a tumbler slit 94 for each tumbler and a driver slit 95 as shown in FIGS. 17 and 20. In the described embodiment viewed from the dial end, the tumbler slits 94 begin from the top side of cylinder 73 and circle clockwise a little more than halfway around the cylinder. The driver slit 95 also begins at the top side but from a point a little to the left and circles around in a similar manner.

Cylinder 73 also contains on the inner surface of its wall, several ridge-like projections. These projections all extend radially inwards a little less than halfway into the void. All of these projections are functionally related to the movements and guidance of the impeller. There are four (4) such projections which include impeller releases 96, an impeller guide 97, an impeller retractor 98, and an impeller ejector 99 all positioned as shown in FIG. 17.

Impeller releases 96 are projections running along flush with the rearward edge of each tumbler slit 94. Impeller releases 96 run the entire length of the slit except for a small portion on the top side as shown in FIG. 18*b*. The impeller guide 97 is a single straight, longitudinal projection on the top inside of the cylinder. It is positioned a little way to the left of the tumbler slits and almost in line with the beginning of the driver slit as shown in FIG. 20. The impeller guide 97 runs across the area occupied by the tumblers only leaving small open spaces at the proximal and distal ends of the lock case. Impeller retractor 98 is also a single projection. As shown in FIG. 17, it begins on the top side near the distal end of the cylinder a short distance from the distal end of the impeller guide and is contingent with the beginning of driver slit 95.

The impeller retractor projection 98 spirals forward in an anti-clockwise direction on the side of cylinder 73 opposite the tumbler slits. Impeller retractor 98 runs a little less than halfway around the cylinder and ends at the proximal end of cylinder 73 near the ends of the tumbler and driver slits on the bottom side.

The last projection, impeller ejector 99, is a single finger-like projection and is positioned at the proximal end of the cylinder in front of the first tumbler slit. The impeller ejector 99 faces the small space left out by the impeller guide 97 at the proximal end and begins in the same line and position as the impeller releases 96.

The arrangement of the projections 96–99 as described above, provides a narrow longitudinal clearing on the top side of the cylinder between the impeller guide 97 and the impeller releases 96, which forms an impeller corridor 100. The beginnings of the tumbler slits 94 are along the center line of corridor 100. Corridor 100 is of just the correct width for impeller bit 89 to pass through longitudinally without being obstructed by any projections. The impeller releases 96 provide parallel partitions for the formation of a plurality of tumbler compartments 101 and a driver compartment 102 (see FIG. 20) corresponding to the tumbler slits 94 and the driver slit 95. Compartments 101 and 102 open into the impeller corridor 100 enabling the impeller bit 89 to enter sideways and rotate through the compartments one at a time. The small space between the proximal end of the impeller guide 97 and the lock case provides an entrance passage 103 for the impeller bit to enter the impeller corridor 100 by rotating from the impeller retractor side. At the back of the lock the small space between the distal end of the impeller guide 97 and the starting end of the impeller retractor projection 98 provides an exit passage 104 for the impeller bit to leave the impeller corridor and rotate toward the impeller retractor 98. The corners of the impeller releases 96 and the impeller guide 97 may be blunted to facilitate the impeller bit to slide or otherwise move across them without catching.

The tumblers 74 are arranged one for each tumbler slit 94 around cylinder 73. Each tumbler consists of an outer ring 105 and an inner ring 107 which are held in relative position by the longitudinal spring force of the locking means holding the tumbler/driver stack together. Every outer ring 105 contains a gating 106 for the projecting bar 81 of drop arm 79 to fall into during the unlocking operation as the bolt is thrown as later described. Every inner ring 107 is fitted with a tumbler ear 108. As shown in FIG. 3, tumbler ear 108 is a narrow radially and inwardly directed flat strip. When the lock is assembled, the tumbler ears pass through their corresponding tumbler slits 94 and hang into the void between the inner wall of cylinder 73 and spindle 62. The ears extend into the void more than three-fourths ($\frac{3}{4}$) of the way to the spindle. The tumblers 74 are rotatable in either direction by their ears 108, and during bolt withdrawing and throwing by their gatings 106. The tumblers however, are only moveable within the range permitted for movement of their ears 108 within their corresponding slits 94. The tumbler ears 108 are made as separate parts and fitted one by one during assembly. For purposes of fitting, each inner ring is provided with a recess 109 of suitable shape and depth on its rear side. In designing a properly balanced tumbler, the weight of the tumbler ear should be taken into account.

The driver 75 is mounted on cylinder 73 adjacent driver slit 95. In the preferred embodiment, driver 75 differs substantially from conventional types. Driver 75 incorporates a thick and circular driving disk 110 with a gap 111 therein at its edge for engaging hook-like member 80 of drop arm 79 (see FIG. 24). The gap 111 is designed for pulling the hook-like member 80 and withdrawing the bolt 78 by clockwise rotation and for pushing the hook-like member and throwing the bolt by anti-clockwise rotation. The diameter of the driving disk 110 is about the same as that of the inner rings 107 of tumblers 74.

The outer edge of driving disk 110 at its forward end, that is the end that faces the tumblers, projects outward to form a thin driver flange 112. The driver flange 112 covers the area of gap 111 as well. Generally driver flange 112 extends radially outward only up to the inward edges of gatings 106 in the outer rings 105 of the tumblers. This enables projecting bar 81 to fall into the gatings 106 of the tumblers 74 during unlocking. In the area of the driver and about perpendicular to gap 111, flange 112 extends further outwards along a curve to beyond the outer edges of tumblers 74 to form an extended driver flange 113. When the driver 75 is in a standard resting position, the extended driver flange 113 is positioned underneath projecting bar 81. In this position the extended flange 113 keeps the projecting bar constantly lifted outside the edges of the tumblers during all tumbler rotations for unlocking as well as during tumbler retracting. In the area of the extended flange 113 toward the side of the driver gap 111, there is a small stabilizer bulge 114 extending the flange still further outwards. Bulge 114 prevents the projecting bar from slipping downwards on its own and helps to stabilize the driver in the standard resting position.

Driver 75 is rotated by a driver ear 115 connected to the driver through the driver slit 95. The driver is provided with a suitable recess 116 on its rear side for accepting the driver ear as shown in FIG. 25. The driver ear 115 projects inward into the void to the same extent as the tumbler ears 108. The driver ear 115 differs substantially from the tumbler ears 108 however, in that the portion hanging within the cylinder is comparatively much broader. The portion of the driver ear inside the cylinder has two (2) wings, an unlocking wing 117 and a locking wing 118. Wings 117 and 118 have their outward edges bent forward to form a broad channel portion facing forward between the wings as shown in FIGS. 26 and 28. A portion of locking wing 118 adjacent to the cylinder wall is narrowed to enable the remaining portion to pass by and not interfere with the impeller retractor projection 98. The channel formed by unlocking wing 117 and locking wing 118 of the driver ear 115 is broader than impeller bit 89. Driver ear 115 must be adequately strong so as to enable the driver 75 which in turn rotates the lock bolt, to be rotated by it without breaking. Further as in the case of the tumblers, the driver should be properly balanced and the weight of the driver ear should also be taken into account in designing the driver.

In the locked condition the drop arm 79 pivoted to bolt 78, is wedged against a V-shaped lock 119 in the lock case 69 as shown in FIGS. 32 and 36. The drop arm 79 is positioned so that its hook-like member 80 lies in line with the driving disk 110 and behind the driver flange 112. Drop arm 79 is biased downward by gravity biasing means. The projecting bar 81 of drop arm 79 extends forward, across the extended driver flange 113 and over the tumblers 74. The hook-like member 80 is of such shape and dimension that even when the projecting bar 81 descends from the extended driver flange 113 on to the outer edges of the tumblers 74 due to rotation of the driver, the tip of its hook still does not touch the edge of driving disk 110. Hook 80 makes contact with driving disk 110 and gap 111 thereof only when the projecting bar 81 drops into the aligned gatings 106 of tumblers 74. All of the gatings must be aligned as the result of the correct combination being dialed into the lock before this can occur.

Cylinder 73 at the distal end beyond the driver slit 95 is threaded on its inner side for engagement with the closer 76. An axial hole 77 of the closer 76 is a little smaller than the outer diameter of the spindle tube 83. The distal end portion of the spindle tube is suitably reduced to provide a shed 120 for close fit into the closer hole for smooth rotation with a minimum of play (see FIGS. 2 and 7). The closer 76 is screwed in from the rear up to the end of the shed 120 and keyed to cylinder 73 so as to enable the smooth rotation of spindle 62 but at the same time to prevent any inward axial movement of the spindle. Thus, the tumbler retractor 85 prevents any outward movement of the spindle as described earlier, and the spindle is prevented from inward movement by shed 120. Closer 76 when correctly positioned lies just behind but not touching the driver ear 115 and the rearward end of the impeller retractor 98.

Operation of the lock is best explained with reference to the enlarged diagrammatic stretch-out view shown in FIG. 40. In this diagram the impeller releases 96, impeller guide 97, impeller retractor 98 and impeller ejector 99 as well as tumbler ears 108 and driver ear 115 are shown with impeller bit 89 in section. Relative positions of the tumbler slits 94 and driver slit 95 are also shown. Spindle tube 83 is shown similarly stretched out in dotted lines to show the relative positioning of spindle slit 84, the impeller retention recess 93 and the tumbler retractor 85.

Beginning with the lock in locked condition with all the tumblers in standard locking position, all the tumbler ears 108 are positioned in alignment at their tumbler slit beginnings along impeller corridor 100. For this position the tumbler gatings 106 are scattered according to their individual combination characters over an arc in the anti-clockwise direction.

The driver 75 is in standard resting position with its driver ear 115 in alignment with the tumbler ears at the beginning of its slit 95 at the end of impeller corridor 100. In this position locking wing 118 of driver ear 115 lies inward of the impeller retractor 98. In the locked position extended flange 113 of driver 75 and the projecting bar 81 and hook-like member of drop arm 79 are all in raised position.

As explained earlier, projecting bar 81 resting on the edge of the extended driver flange 113 will be suspended outside the edges of tumblers 74 without touching them. Hook-like member 80 will also be in a suspended position outside the edge of driving disk 110. The gap 111 in the driver will be about ninety degrees (90°) from top center in the anti-clockwise direction for the initial secured position of the lock.

At the beginning of the unlocking process, impeller bit 89 is in alignment along impeller corridor 100 at the starting end. In this position, impeller bit 89 is within slit 84 near the front end of the lock but not in the impeller retention recess 93, and is in contact with ear 108 of the first tumbler which is the farthest tumbler from the driver. Impeller bit 89 under constant pressure from spring 92, is biased to slide rearwardly in the spindle slit 84 and also along the impeller corridor 100 towards the successor tumbler ears 108 and the driver ear 115. This motion is temporarily prevented because lateral arm 91 of impeller bit 89 is blocked by the tumbler ear. It may be observed that the longitudinal arm 90 pointing distally in the impeller corridor 100 is of suitable width that it freely enters and occupies the space between the tumbler ear 108 and the impeller guide 97.

When the impeller bit 89 is along the impeller corridor 100, the impeller retractor 85 on the spindle tube 83 lies in a longitudinal line across the tumbler slits 94 a little before their ends. Also when the impeller bit 89 is along the impeller corridor 100, the dial 60 on the outside will be at zero (0), the starting point.

It must be noted that with the impeller bit along the impeller corridor in the area of the tumblers, the dial is not rotatable in the anti-clockwise direction as such movement of impeller bit 89 is blocked by impeller guide 97. It should also be noted that longitudinal arm 90 of the impeller bit when in contact with the tumbler ear 108 as shown in FIG. 40, projects a little beyond the thickness of the tumbler ear and similarly beyond the front face line of the adjacent impeller release 96. The forward corners of the impeller release 96 on the corridor side are slightly cut as shown to provide a slanting surface for camming purposes. The forward corners of the tumbler ears 108 and the impeller guide 97 on the corridor sides may also be similarly cut to facilitate the smooth, rearward sliding of impeller bit 89.

In order to discuss the unlocking process for the preferred embodiment of the present invention, the opening process will be discussed for the four (4) tumbler lock shown in FIG. 40 which is assumed to be arranged to have a combination consisting of four (4) characters 51-23-97-41. The process of positioning the tumblers for unlocking begins with dial 60 being rotated in the clockwise direction from 0 to 51. This rotation causes impeller bit 89 to move into and along the first tumbler compartment 101. In the process, the force of longitudinal arm 90 will rotate tumbler ear 108 of the first tumbler 74, thereby moving the first tumbler to the required position to bring its gating 106 to the top side in line underneath projecting bar 81. At the commencement of this rotation as longitudinal arm 90 of impeller bit 89 reaches the edge of the first impeller release 96, it is cammed forward in the lock a little against spring pressure by the slanting corner of the impeller release. This results from the fact that longitudinal arm 90 projects beyond tumbler ear 108 and the front face of the impeller release 96. This releases the tumbler ear 108 from the rearward pressure exerted on it by the spring-loaded impeller bit as shown in FIG. 41(*a*). The pressure is relieved as long as the impeller bit 89 moves along the impeller release 96 in the tumbler compartment. On reaching the 51 mark, the dial is reversed anti-clockwise to 0. This causes impeller bit 89 to stop moving the first tumbler and return, leaving tumbler ear 108 of the first tumbler behind at the exact point relating to the 51 mark. As the dial is returned toward the 0 mark and the impeller bit 89 reaches corridor 100, the impeller bit slides off the first impeller release 96 into the corridor and plunges rearward towards the distal end of the lock due to spring pressure. The impeller bit moves rearward until it comes to rest against ear 108 of the second tumbler. In this position impeller bit 89 is against the second tumbler in the same manner that it rested before against the ear of the first tumbler.

The process of clockwise rotation and reversal of the dial is now repeated but this time up to the second character 23. The clockwise rotation to character 23 will cause the impeller bit 89 to move and rotate the second tumbler by its ear to position the gating of the second tumbler in line with the gating of the first tumbler and with projecting bar 81. The reverse rotation to zero (0) will bring impeller bit 89 back into corridor 100 again, causing it to plunge further rearward toward the distal end and come to rest against the ear of the third tumbler.

The process of clockwise rotation and reversal of the dial is now affected a third time; this time up to the third character 97. The clockwise rotation of the third tumbler to 97 results in the positioning of its gating in line with the projecting bar. The reverse rotation to zero (0) of the dial will bring impeller bit 89 back into corridor 100 again, causing it to plunge further rearward and come to rest against the ear of the fourth tumbler.

The process of clockwise rotation and reversal is now affected a fourth time. This time the dial is moved to the fourth character 41, thus positioning the fourth tumbler gating in line with the projecting bar. When the impeller bit is brought back into the corridor again, it plunges rearward for the last time and comes to rest against driver ear 115 in the channel portion between wings 117 and 118.

Having positioned all four (4) tumblers 74 according to a proper combination and having brought their gatings 106 in alignment with projecting bar 81, the lock is now ready to have the bolt withdrawn. Beginning with the dial at the zero (0) mark, it is now rotated again in a clockwise direction as far as it goes, which will be the maximum rotation possible for tumbler positioning. As the result of this rotation, impeller bit 89 pushes driver ear 115 by its unlocking wing 117 and causes the driver 75 to rotate. In the course of this rotation, projecting bar 81 first climbs over the stabilizer bulge 114 and then slides down the curve of the extended driver flange 113 as shown in FIGS. 32 and 36. As it descends, the projecting bar 81 enters the aligned gatings 106 of the tumbler 74. As this happens, hook-like member 80 simultaneously descends onto the edge of the driving disk 110 and enters the gap 111. When the projecting bar 81 and the hook-like member 80 descend fully into the gatings 106 and gap 111 respectively, the drop arm 79 is clear of the V-shaped block 119 on the lock case. Drop arm 79 is then moved by rotation of the driver so as to effect withdrawal of the bolt. When the drop arm moves, projecting bar 81 rotates tumblers 74 a little further from their respective set positions in the clockwise direction. The extra length of tumbler slits 94 enables this whenever one of the combination numbers is set at or near the maximum. The lock is now unsecured and its associated door can be opened.

To throw out the bolt, the dial 60 is reversed back to zero (0). In this reverse direction, impeller bit 89 in engagement locking wing 118 of driver ear 115, rotates the driver in the reverse direction back to or near its original standard resting position. This reverse rotation affects reverse movements for the drop arm 79. The small shift in the tumbler positions caused by the projecting bar 81 in the process of withdrawing the bolt is also reversed.

Even though the bolt is now extended, it is not secured because tumbler gatings 106 are still aligned. Further, impeller bit 89 is still in contact with driver ear 115 as shown in FIG. 41(*b*). Therefore, the tumblers and driver can be drawn in and thrown out repeatedly if necessary, with the lock in this condition.

For properly securing the lock, dial 60 is partially rotated in the anti-clockwise direction to a reset position from the zero (0) position through the ungraduated portion of the dial. This anti-clockwise rotation of one-half ($\frac{1}{2}$) turn affects two important things simultaneously; namely, impeller retraction and tumbler scattering.

The impeller retractor projection 98 functions as a non-positive motion cam and draws the impeller by its bit from the distal end of the lock to the proximal end against the pressure of spring 92. The impeller bit 89 which is at the driver end after the lock has been opened, leaves the impeller corridor 100 through exit passage 104 as it is thrust against impeller retractor 98 by the counterclockwise rotation of the dial (see FIG. 20). The reduced size of locking wing 118 of driver ear 115 enables the forwardly bent edge of the remaining portion to freely pass inward to the impeller retractor and permit the mating surfaces of the impeller retractor and the impeller bit to make contact and to cam out the impeller bit from the channel area between the wings of driver ear 115 during the initial stage of the anti-clockwise rotation. The relationship of these parts and their interaction is shown in FIG. 41(*b*). As the impeller moves further forward in the lock due to continued anti-clockwise rotation, bit 89 eventually reaches the proximal end of the impeller retractor projection 98 in the cylinder as well as the impeller retention recess 93 in spindle tube slit 84. Impeller 87 rotates in response to the force applied by the retractor projection and bit 89 slides into recess 93 during the final stage of anti-clockwise rotation. Bit 89 remains retained temporarily but firmly under the pressure of spring 92.

With respect to tumbler retraction, the tumbler retraction projection 85 on the spindle directly pushes all the tumbler ears 108 from their respective positions in which their gatings are aligned and rotates them back to their standard locking positions along impeller corridor 100. This affects fully spreading out of the tumbler gatings and positions ears 108 in line along corridor 100 as necessary to begin the unlocking process again.

To complete the securing of the lock, the dial is rotated again from the full anti-clockwise reset position; this time clockwise one-half (½) turn back to zero (0). As this is done, impeller bit 89 held in recess 93, leaves the area of impeller retractor 98 and enters impeller corridor 100 through entrance passage 103 at the proximal end of the cylinder. As impeller bit 89 reaches the impeller ejector projection 99, the bit is pushed out of recess 93 moving it back into the center line of slit 84. Immediately after being pushed out of recess 93, the freed impeller bit plunges towards the distal end of the lock and comes to rest against the first tumbler ear 108, which is already in its standard locking position as it was at the start of its unlocking process. Thus, the lock has now been brought once again to full security. From this position the cyclic unlocking and locking operation can be repeated by dialing the correct combination numbers.

In case the tumblers are positioned for any combination other than the one which will open the lock, tumbler gatings 106 will not be in alignment with projecting bar 81 of drop arm 79. In such situations, when impeller bit 89 reaches driver ear 115 and rotates it, the projecting bar 81 instead of sliding down the curve off the extended driver flange 113 will be kept in a lifted position on the edges of the incorrectly positioned tumblers. Therefore, the driver will freely rotate without throwing the bolt because driving disk 110 will not be in contact with hook-like member 80 of drop arm 79.

In order to reset the lock to operate on a new combination, the tumblers 74 are first positioned according to the existing combination characters by part rotations and reversals as previously described. When the impeller bit 89 reaches driver ear 115 after so positioning, a change key (not shown) is used in a conventional manner to release this spring pressure on the stack which maintains the inner rings and outer rings of the tumblers in relative position. The dial 60 is now rotated in the anti-clockwise position beyond zero (0) for retracting of the impeller and the tumbler (inner rings and ears only) and for the impeller bit to re-establish contact with the first tumbler ear in the corridor. The inner rings and ears of the tumblers are now positioned according to the selected characters of the new combination by part rotations and reversals in the same manner as for unlocking. During this process the outer rings remain positioned with their gatings aligned. In some embodiments however, depending on the frictional characteristics of the inner and outer rings, it may be desirable to provide a positive means of holding the gatings 106 in alignment. When the impeller bit reaches the driver ear after positioning all the tumblers, the change key is used to re-establish that then relative positions of the inner and outer rings and the lock is now ready to use with a new combination. It should be noted that the driver is not engaged in any way during the resetting process.

The preferred embodiment of the combination lock described above provides many important advantages over conventional forms. The lock is theoretically unpickable in all respects and the projecting bar never touches the tumblers when the tumblers are rotated for unlocking or retracting. Locking is definite and complete in the lock of the preferred embodiment, leaving no room for doubt or disparity. All the tumblers are simultaneously and collectively rotated to their standard locking position. The lock of the present invention will not reveal its combination even from a fully unlocked position. Should the lock be left halfway through the process of unlocking, nothing about the combination can be determined. The lock also does not permit selective manipulation of tumblers.

The lock of the preferred embodiment of the present invention in contrast to conventional types offers a simple, speedy and standard system of operation for locking and unlocking. In a conventional combination lock with four (4) tumblers, for example, unlocking involves a cumulative total of fifteen (15) rotations, ten (10) of which are full turns. Fourteen (14) of these rotations involve careful observation of four (4) combination numbers, repeatedly four (4), five (5), three (3), and two (2) times. The laborious process also involves changing of directions which introduces additional possibilities for error. Locking on the other hand, though less cumbersome, is never definite and may sometimes require in addition to a part rotation for throwing a bolt, more than four (4) continuous full rotations in any one direction to achieve complete scattering of the tumblers. Thus, the combined process of unlocking and locking a conventional lock may involve as many as twenty (20) rotations, fourteen (14) of which are full turns.

In contrast to the conventional lock discussed in the preceding paragraph, the four (4) tumbler lock made in accordance with the embodiment described requires only one (1) part rotation and reversal for setting each tumbler and one (1) part rotation for withdrawing the bolt. Each of the four (4) combination numbers must be observed only once during its corresponding part rotation during unlocking. The reverse rotations need no careful observation as anti-clockwise rotation beyond zero (0) is positively prevented. The same applies to the bolt withdrawing part rotation as the dial is simply rotated as far as it goes. Commencing directions for all part rotations are the same and the dial clearly indicates the required direction. In any event, the dial is not rotable in the wrong direction. Thus, one will not err or be confused in the operation of the lock. As regards to locking, bolt throwing and tumbler retracting involves only two (2) continuous part rotations and one (1) reversal. Arithmetically the complete cycle of unlocking and locking involves only six (6) part rotations and reversals, all aggregating to less than four (4) full rotations on an average.

Changing the combination of the lock of the preferred embodiment to a new combination is also an equally simple and swift operation. It involves only one (1) extra cycle of tumbler positioning as against the three (3) extra cycles required in conventional locks. In the case of the conventional lock fitted for a safe, when one is to reset the lock to a new combination, the procedure involves the following stages: (1) positioning the tumbler for unlocking according to the old combination using a normal setting mark, withdrawing the bolt and opening the safe door; (2) with the safe door in open position, throwing out the lock bolt and positioning the tumblers again according to the old combination but using a second setting mark; (3) inserting a change key and unlocking the cam; (4) positioning the tumblers according to the new combination, again using the second setting mark; (5) unlocking the cam and removing the change key; (6) positioning the tumbler according to the new combination but using the normal setting mark and withdrawing the lock bolt; (7) closing the safe door, throwing out the lock bolt and scattering the tumblers.

For an ordinary user, the resetting procedure is extremely laborious. One skilled in the art would know that in a conventional lock with four (4) tumblers the resetting procedure involving three (3) extra cycles of tumbler positioning operations requires a minimum of forty-four (44) extra rotations for the extra operations. In this there are thirty-four (34) rounds, forty-two (42) rotations involving careful observation of combination numbers, and thirteen (13) direction changes. Arithmetically on an average, the entire extra procedure may involve an aggregate of thirty-seven (37) full rotations. The extra setting mark also causes confusion. In fact, for these reasons users of conventional locks refrain from setting their locks very often. Some even engage the services of professionals, thus losing the benefit of total secrecy.

In contrast to the above, in a combination lock made in accordance with the embodiment described, resetting to a new combination involves only the following steps: (1) positioning the tumblers for unlocking according to the old combination using the one and only setting mark, withdrawing the lock bolt and opening the safe door; (2) with the door in the open position, throwing out the lock bolt, inserting the change key, unlocking the stack, retracting the tumbler inner rings, and bringing the impeller bit back to the starting end; (3) positioning the tumbler inner rings according to the new combination using the same setting mark, locking the stack and withdrawing the lock bolt; (4) closing the door, throwing out the lock bolt and retracting the tumblers, bringing the impeller bit back again to the starting position.

Even for the ordinary user, the procedure is very easy to accomplish. The procedure involves only one (1) extra cycle of tumbler positioning which is accomplished using the same setting mark. In a four (4) tumbler lock the entire extra operation involves only six (6) part rotations and reversals, all aggregating to less than four (4) full rotations on an average.

It should be noted that the preferred embodiment of the present invention provides for an extraordinary dual control or multiple control system using a single lock. For example, with a four (4) tumbler lock one person can control the first two (2) numbers and another person can control the other two (2) numbers. Either person can reset his numbers according to his wish and operate the dial for positioning tumblers without revealing numbers to the other. As the dial is reversed to zero (0) after positioning each tumbler, one person taking over from another will not know the number used by the preceding person. In fact according to the system, every tumbler in the lock can be safely controlled by a different person to provide a system for multiple control if desired.

In a varied application of the invention shown in FIG. 42, indirect drive is provided for the previously described embodiment. This is effected by cutting the spindle in two as shown. The tubular section of the spindle serves as driven spindle 121 and the rest as a driving spindle 122. A driver gear wheel 56 is mounted on driving spindle 122 which is in contact with a driven gear wheel 58 on spindle 121 so as to transfer rotational movement between the spindles.

In yet another embodiment, the driven spindle is extended rearwardly and fit with another dial on the inside for usage as a two (2) side door lock shown in FIG. 43. The inside dial 123 is marked in the manner of a mirror image of the dial at the front.

In both of the above alternative embodiments, the gear ratio can be altered by having unequal gear wheels to increase the angle of rotation. Using unequal gear ratios for gear wheels 56 and 58, the dial can be graduated over a greater arc or even a full circle if desired.

A simpler version of the tumbler for use in the invention which consists of a single ring only is shown in FIGS. 44 through 46. The tumbler ear 1108 having a spring type slideable clip device (not separately shown) is directly connected to the outer ring 174 as shown in FIGS. 44 and 45. The ear is firmly held to the outer ring under spring pressure. During normal tumbler positioning during lock opening, the tumbler ring 174 rotates as the ear is rotated by the impeller bit. The tumbler outer ring rotates with the ear to position the gating 106 to the proper location for opening. To set a new combination, the tumblers are first positioned according to the old combination. The outer rings are held fast in position by holding means (not separately shown) such as a thin rod. This avoids the requirement for a change key or unlocking cam for unlocking the stack. The process of resetting the lock is continued by retracting the tumblers to standard position through the action of the tumbler retractor on the spindle by anti-clockwise rotation. Thereafter the tumblers are repositioned by the impeller bit as the new combination characters are dialed while the outer rings are held stationary. The force of dial rotation forces each ear to slide along the fixed outer ring to new positions. In yet an even more simplified version of this tumbler, the outer ring is not circular but only part circular as shown in FIG. 46.

Another embodiment of the present invention can be used as an ordinary two-sided door lock. In this embodiment shown in FIG. 47, a longitudinally cut half-cylinder 273 with suitably cut tumblers 274 are used. The tumblers consist of outer rings only and the ears 108 are directly clipped to the outer rings. In this embodiment, a short plug 124 is mounted between the lock case and cap. Plug 124 is elliptical in section. It contains a full length tumbler section with a slit 284 and impeller retention recess 293 in the upper half for operation of an impeller of the type shown in the other embodiment. Plug 124 contains a full length square hole 125 in its lower half. A long square spindle 126 runs through the square hole. Unmarked knobs or handles 127 are fitted at the ends of the spindle on either side of the lock and door for rotating the plug. Rotation of the plug beyond the required points is limited in either direction by two (2) stop projections 128 which act against a stop block 129 which is an integral part of the lock case and positioned below the plug. A plurality of small grooves or ridges 130 are found on the bottom side of the plug beginning at the center line and running anti-clockwise. A spring-loaded pin tumbler 131 is positioned in a receptacle 132 in the stop block 129. Pin tumbler 131 engages the grooves and provides temporary stops or "clicks" which one can feel when rotating the handles. The gatings 106 and tumbler retractor 285 function similar to such parts in the other embodiments.

In operating this embodiment, instead of looking at numbers on a graduated dial, one counts the number of clicks in each rotation. For example, in a lock with four (4) tumblers and ten (10) grooves and with combination characters of 6-4-3-7, one rotates the handle first up to the sixth click and reverses to standard position. Rotations are similarly continued up to the fourth, third, and seventh click and the bolt withdrawn thereafter by a further rotation. Resetting is also affected by counting clicks. This lock can be operated in the dark or even by a blind person.

To provide rotation over a wider arc, a gear wheel arrangement can be provided or a telephone type rotary dialing system could be used.

Thus the new lock mechanism of the present invention achieves the above-stated objectives, eliminates difficulties encountered in the use of prior devices, solves problems and attains the desirable results described herein.

In the foregoing description, certain terms have been used for brevity, clarity and understanding. However, no unnecessary limitations are to be implied therefrom because said terms are used for descriptive purposes and are intended to be broadly construed. Moreover, the descriptions and illustrations given are by way of examples and the invention is not limited to the exact details shown or described.

Having described the features, discoveries, and principles of the invention, the manner in which it is utilized, and the advantages and useful results obtained, the new and useful structures, devices, elements, arrangements, parts, combinations, systems, equipment operations, methods, and relationships are set forth in the appended claims.

I claim:

1. A lock apparatus having a dial for setting a combination of sequential characters which when correctly set, enables unlocking of the lock, the lock having a case, a bolt and ring tumblers, each of said tumblers corresponding with a correct character and a position in the sequence of combination characters, said tumblers having a scattered condition and an unscattered condition, a tumbler being in the unscattered condition responsive to the correct character for the tumbler being set in the correct position in the sequence, comprising:

a rotatable spindle in operative connection with said dial, said spindle journalled in said case and rotatable about an axis of rotation, said spindle having a first axial end and a second axial end;

an impeller mounted for axial movement on said spindle, said impeller including an impeller bit extending radially outward of said spindle;

a hollow cylinder mounted on said case coaxial with said spindle, said hollow cylinder including a plurality of spaced, circumferential tumbler slots extending therethrough, said cylinder further including cam guide projections adjacent each of said tumbler slots, said cam guide projections extending radially inward in said hollow cylinder, each of said cam guide projections terminating at an axial corridor inside said hollow cylinder;

a plurality of rotatable ring tumblers mounted for movement on said hollow cylinder, each tumbler mounted adjacent one of said tumbler slots, each tumbler including an ear extending radially toward said spindle through said adjacent tumbler slot, said ears of said tumblers being positioned in said corridor when said tumblers are in the scattered condition, each of said tumblers further including a gating in an external surface thereof, said gatings of said tumblers being aligned in said unscattered condition;

a driver mounted for movement adjacent said second end of said spindle, said driver including driver engagement means for engaging said impeller when said impeller is adjacent said second end;

bolt engagement means for selectively engaging said bolt and said driver responsive to alignment of said gatings of said tumblers;

biasing means for biasing said impeller toward said second end of said spindle;

whereby when unlocking said lock beginning with said tumblers in said scattered conditions and said impeller adjacent said first end of said spindle, said spindle bit engages said ear means of a first tumbler in said corridor, upon turning said dial in a first direction to a first combination character said impeller bit engages and is supported on a first cam guide projection associated with said first tumbler, said first combination being dialed and said gating of said first tumbler set in the unscattered condition: said dial is thereafter turned in a second opposed direction whereby said first tumbler is disengaged from said impeller bit and said bit is supported on said first cam guide projection until said bit returns to said corridor, wherein said impeller moves axially toward said second end of said spindle; said impeller bit thereafter engaging said ears of said further tumblers sequentially with the setting of combination characters to place the gatings of said tumblers in the unscattered conditions, whereby after all of said combination characters have been set said impeller engages said driver and said bolt engagement means engages said driver and said bolt, enabling opening of the lock.

2. The apparatus according to claim 1 and further comprising an impeller guide projection on said lock case preventing movement of said impeller bit in the opposed direction beyond the axial corridor when said bit is longitudinally in position to engage tumblers.

3. The apparatus according to claim 1 wherein said tumblers have an outer surface including a gating, said gatings being in alignment in the unscattered condition; said driver is mounted coaxially with said spindle and includes a flange having an extended portion extending outside the outer surfaces of said tumblers and said driver incorporates a hooked gap; and said bolt engagement means comprises a drop arm in operative connection with said bolt, said arm including a hook-like projection and a projecting bar extending adjacent and sized for acceptance by said aligned gatings and in engagement with said extended portion in an initial secure position of said driver, said arm being biased toward said driver by biasing means, whereby rotation of said driver disengages said extended portion and said projecting bar and enables engagement of said hook-like projection and hooked gap of said driver upon acceptance of said projecting bar in said gatings.

4. The apparatus according to claim 3 wherein said driver includes a circular access hole, said spindle extending through said hole, and said driver engagement means is a driver ear extending radially inward in said hole to engage said bit.

5. The apparatus according to claim 4 wherein said cylinder incorporates a driver slit therethrough and said driver ear extends through said driver slit to engage said impeller bit.

6. The apparatus according to claim 4 and further comprising:

second movement means for moving said tumblers to said initial scattered conditions; and third movement means for moving said impeller from engagement with said driver to engagement with the first tumbler corresponding to the first character of the combination, said second and third movement means operative in response to setting said dial to a reset position.

7. The apparatus according to claim 6 wherein said second movement means comprises a longitudinal projection in said spindle for aligning said tumbler ears adjacent the axial corridor when said dial is set to the reset position.

8. The apparatus according to claim 7 wherein said third movement means comprises a helical impeller retractor projection on said cylinder engaging said impeller bit and camming said impeller toward said first axial end of said spindle to a retracted point beyond said first tumbler when said dial is set to the reset position, holding means for holding said impeller at said retracted point, and impeller releasing means for releasing said bit adjacent said axial corridor.

9. The apparatus according to claim 8 wherein said spindle includes a hollow tube portion with a longitudinal slit, said impeller is mounted internal to said tube portion with the bit extending through said slit, and said holding means is a retention recess in said slit extending in said first direction from a center line of said slit forward of said first tumbler, and said releasing means is an impeller ejector projection on said cylinder.

10. The apparatus according to claim 3 wherein said case includes blocking means for blocking movement of said drop arm when said arm is in engagement with said extended portion of said flange, whereby movement of said bolt is prevented when said gatings are not in alignment.

11. A lock apparatus having a dial for setting a combination of sequential characters which when correctly set, enables unlocking of the lock, the lock having a case, a bolt and ring tumblers, each of said tumblers corresponding with a correct character and a position in the sequence of combination characters, said tumblers having a scattered condition and an unscattered condition, a tumbler being in the unscattered condition responsive to the correct character for the tumbler being set in the correct position in the sequence, comprising:

a rotatable hollow spindle in operative connection with said dial, said spindle having an interior area, said spindle journalled in said case and rotatable about an axis of rotation, said spindle having a first axial end and a second axial end, said spindle further having an axial slit, said slit including a recess adjacent said first end, said recess extending in a first rotational direction from said slit;

an impeller mounted for movement on said spindle, said impeller including a body portion mounted for movement axially and rotationally inside said interior area, and a bit, said bit extending radially outward from said spindle through said slit and movable therein;

a hollow cylinder mounted on said case coaxial with said spindle, said hollow cylinder including a plurality of spaced, circumferential tumbler slots extending therethrough, said cylinder further including cam guide projections adjacent each of said tumbler slots, said cam guide projections extending radially inward in said hollow cylinder, each of said cam guide projections terminating at an axial corridor inside said hollow cylinder, said cylinder further including a helical impeller retractor projection projecting inward in said cylinder and extending from adjacent said second end of said spindle to adjacent said first end, and said cylinder further including an ejector projection extending inward in said cylinder adjacent said first end of said spindle and said corridor;

a plurality of rotatable ring tumblers mounted for movement on said hollow cylinder, each tumbler mounted adjacent one of said tumbler slots, each tumbler including first engagement means extending radially toward said spindle through said adjacent tumbler slot, said first engagement means of said tumblers being positioned in said corridor when said tumblers are in the scattered condition, each of said tumblers further including a gating in an external surface thereof, said gatings of said tumblers being aligned in said unscattered condition;

a driver mounted for movement adjacent said second end of said spindle, said driver including second engagement means for engaging said impeller when said impeller is adjacent said second end;

third engagement means for selectively engaging said bolt and said driver responsive to alignment of said gatings of said tumblers, said third engagement means enabling retraction of said bolt responsive to movement of said driver in the first rotational direction;

biasing means for biasing said impeller toward said second end of said spindle;

whereby when unlocking said lock beginning with said tumblers in said scattered conditions and said impeller adjacent said first end of said spindle, said impeller bit engages said first engagement means of a first tumbler in said corridor; upon turning said dial in the first direction to a first combination character said impeller bit engages and is supported on a first cam guide projection associated with said first tumbler, said first combination being dialed and said gating of said first tumbler set in the unscattered condition; said dial is thereafter turned in a second opposed direction whereby said first tumbler is disengaged from said impeller bit and said bit is supported on said first cam guide projection until said bit returns to said corridor, wherein said impeller moves axially toward said second end of said spindle; said spindle bit thereafter engages said first engagement means of said further tumblers sequentially with the setting of combination characters to place the gatings of said tumblers in the unscattered conditions, whereby after all of said combination characters have been set said impeller engages said driver and said third engagement means engages said driver and said bolt, and rotation of said dial in said first direction moves said bolt to unlock said lock; and whereby thereafter rotation of said dial in said second direction moves said bolt to close said lock and engage said bit and said impeller retractor projection and whereupon further rotation in said second direction said bit is carried on said retractor projection against the force of said biasing means to the first end of said spindle and said impeller bit is deposited in said recess in said slit; and thereafter upon rotation of said dial in said first direction said bit contacts said ejector projection ejecting it from said recess and into said corridor to repeat the unlocking process.

* * * * *